US008790230B2

(12) United States Patent
Piraneo

(10) Patent No.: US 8,790,230 B2
(45) Date of Patent: Jul. 29, 2014

(54) METHOD OF MANUFACTURING A STAND-UP BAG

(75) Inventor: Carmelo Piraneo, Farmington, CT (US)

(73) Assignee: Anapo Plastics, LLC, Farmington, CT (US)

( * ) Notice: Subject to any disclaimer, the term of this patent is extended or adjusted under 35 U.S.C. 154(b) by 390 days.

(21) Appl. No.: 12/533,899

(22) Filed: Jul. 31, 2009

(65) Prior Publication Data

US 2011/0019943 A1 Jan. 27, 2011

Related U.S. Application Data

(63) Continuation of application No. 12/507,586, filed on Jul. 22, 2009.

(51) Int. Cl.
*B31B 1/90* (2006.01)

(52) U.S. Cl.
USPC ..... 493/218; 493/186; 493/219; 493/936

(58) Field of Classification Search
USPC ..... 493/186, 218, 219, 189, 194, 240, 243, 493/267, 936
See application file for complete search history.

(56) References Cited

U.S. PATENT DOCUMENTS

| | | | | |
|---|---|---|---|---|
| 227,147 | A | 5/1880 | Campbell | |
| 287,753 | A | 10/1883 | Blowers | |
| 1,671,050 | A | 5/1928 | Snyder | |
| 1,672,322 | A * | 6/1928 | Keiser et al. | 383/119 |
| 2,203,726 | A | 6/1940 | Cornelis | |
| 2,985,355 | A | 5/1961 | Read | |
| 3,023,679 | A | 3/1962 | Piazze | |
| 3,136,475 | A | 6/1964 | Geimer | |
| 3,484,037 | A | 12/1969 | Kugler | |
| 3,618,478 | A | 11/1971 | Piazze | |
| 3,682,372 | A | 8/1972 | Rodley | |
| 3,743,172 | A | 7/1973 | Ackley et al. | |
| 3,764,000 | A | 10/1973 | Jentsch | |
| 3,812,644 | A * | 5/1974 | Kamikawa et al. | 53/459 |
| 3,860,164 | A | 1/1975 | Dworkin | |
| 4,174,932 | A | 11/1979 | Herrington | |
| 4,526,565 | A | 7/1985 | Hummel et al. | |

(Continued)

FOREIGN PATENT DOCUMENTS

| | | |
|---|---|---|
| DE | 4220474 A1 | 1/1994 |
| EP | 1 338 523 A1 | 8/2003 |

(Continued)

OTHER PUBLICATIONS

Hot to Go bag (photos).

(Continued)

*Primary Examiner* — Sameh H. Tawfik
(74) *Attorney, Agent, or Firm* — Flaster/Greenberg, P.C.

(57) ABSTRACT

A flat bottom, stand-up bag and a method of manufacturing the bag is provided. The bag includes a bottom wall, opposing front and rear walls and two side walls. The side walls connect the front and rear walls and the bottom wall is connected to the other walls at their lower edge. The bag preferably incorporates a continuous polymer web material forming the front wall and rear wall of the bag, as well as the bottom wall. The side walls include gussets and a triangular base portion formed at the intersection between the bottom wall and the side walls.

17 Claims, 10 Drawing Sheets

(56) References Cited

U.S. PATENT DOCUMENTS

| | | | | |
|---|---|---|---|---|
| 4,655,737 | A * | 4/1987 | Benoit | 493/194 |
| 4,685,276 | A * | 8/1987 | Kiel | 53/459 |
| 4,848,930 | A | 7/1989 | Williams et al. | |
| 4,871,100 | A | 10/1989 | Posner | |
| 4,892,511 | A * | 1/1990 | Luciano et al. | 493/194 |
| 5,006,186 | A * | 4/1991 | Yokoyama | 156/211 |
| 5,102,384 | A | 4/1992 | Ross et al. | |
| 5,236,531 | A | 8/1993 | Yokoyama | |
| 5,338,118 | A | 8/1994 | DeMatteis | |
| 6,056,681 | A * | 5/2000 | Ross | 493/218 |
| 6,095,687 | A | 8/2000 | DeMatteis | |
| 6,113,269 | A | 9/2000 | DeMatteis et al. | |
| 6,171,226 | B1 | 1/2001 | DeMatteis | |
| 6,186,933 | B1 | 2/2001 | DeMatteis | |
| 6,334,710 | B1 | 1/2002 | Kuge et al. | |
| 6,397,560 | B1 | 6/2002 | Weder | |
| 6,561,963 | B2 | 5/2003 | Totani | |
| 6,942,100 | B2 | 9/2005 | Su | |
| 7,041,042 | B2 | 5/2006 | Chertkow et al. | |
| 7,175,583 | B2 | 2/2007 | Su | |
| 7,335,149 | B1 | 2/2008 | Hanson | |
| 2003/0054929 | A1 | 3/2003 | Post et al. | |
| 2003/0147567 | A1 | 8/2003 | Pang | |
| 2003/0152298 | A1 | 8/2003 | Luoni | |
| 2004/0058103 | A1 | 3/2004 | Anderson et al. | |
| 2005/0139508 | A1 | 6/2005 | Su | |
| 2005/0181923 | A1 | 8/2005 | Su | |
| 2006/0120635 | A1 | 6/2006 | Su | |
| 2009/0232420 | A1 | 9/2009 | Eisenberg et al. | |

FOREIGN PATENT DOCUMENTS

| | | | |
|---|---|---|---|
| FR | 2 600 627 | | 6/1986 |
| FR | 2 744 699 | | 2/1997 |
| GB | 2 317 159 | A | 3/1998 |
| JP | 7-314587 | | 12/1995 |
| JP | 2001192040 | A | 7/2001 |
| JP | 2001206385 | A | 7/2001 |
| JP | 2002332049 | A | 11/2002 |
| JP | 2003335347 | A | 11/2003 |
| JP | 2008-56326 | A | 3/2008 |
| WO | WO 98/35886 | | 8/1998 |

OTHER PUBLICATIONS

Albertson's bag (photos).
Bag with top sealing means (photos).
Subway bag (photos).
Takeout/Take The Flavor Home bag (photos).
Green bag (photos).
PickUpStix.com bag (photos).
The Original Smith's bag (photos).

* cited by examiner

METHOD OF MANUFACTURING A STAND-UP BAG

RELATED APPLICATIONS

The present application is a continuation of co-pending application Ser. No. 12/507,586, filed Jul. 22, 2009.

TECHNICAL FIELD

The present invention generally relates to flexible bags and, more particularly, to bags having a flat bottom for providing support in a stand-up position. Specifically, the present invention relates to flat bottom, stand-up bags that are fabricated using a polymer material and manufactured on a continuous basis.

BACKGROUND OF THE INVENTION

Stand-up bags are used in a wide variety of applications. One common application is to hold food and other items that are purchased at retail establishments, such as department or grocery stores. Stand-up bags have also been applied to fast food establishments as a means for transporting the purchased food. The stand-up bags provide a relatively inexpensive way to deliver multiple items to a customer who can easily transport the items and secure them in a stable position on any countertop or similar surface.

A common type of stand-up bag is fabricated from a paper material. The paper may be coated, such as with a wax or a polymer, so as to resist liquid spills and grease absorption. Generally, liquid spills or other moisture application to a paper bag will destroy the integrity of the bag or the paper, causing the bag to fail and damage to the material inside the bag. Stand-up bags may also be fabricated from a polymer material so as to reduce the risk of bag failure, since most polymer materials are substantially resistant to moisture absorption.

There are a number of types of polymer bags. One form of polymer bags includes a sealing flange that extends from the bottom end of the bag, which may prevent the bag from standing upright. Polymer bags may also be formed in a manner similar to paper bags, including a number of folded layers at the bottom. In some bags, a separate patch is applied to cover the flange or folds to create a flat surface and to increase strength.

The addition of patches and the folding process typically results in additional process steps. In addition, the bottom surface of the bag includes multiple layers of material, which also adds to material costs. Thus, a manufacturing process eliminating or minimizing one or more of these drawbacks will serve to create a more economical product.

SUMMARY OF THE INVENTION

The present invention relates to the formation of a bag, in particular a bag having a flat bottom wall, opposing front and rear walls and two side walls. The side walls connect the front and rear walls with the bottom edge of these walls connected to the bottom wall. The bag of the present invention may be formed by providing two adjacent webs of material, with one edge being joined at a fold line. The adjacent webs are positioned parallel to one another and extend away from the fold line. In forming the bag, an inwardly directed bottom fold is provided along the fold line, such that the bottom fold is positioned between the web layers. The web layers are welded along a first line, transverse to the inwardly directed bottom fold. In the manufacturing process, a second transverse weld line is formed in a parallel space relationship with the first weld line. The folded web portion between the first weld line and second weld line is separated from the web, forming a tubular structure having a closed end along the bottom fold. Inwardly directed gusset folds are provided on both the first and second weld lines. The gusset folds are positioned between the web layers and are directed transverse to the bottom fold. In forming the gusset fold along the side walls, a triangular base portion is created at the intersection of the inwardly directed bottom fold and the inwardly directed gusset fold. The triangular base portions are directed along the first and second weld lines and define the width of the side walls.

In the manufacturing process of the bag, the adjacent webs of material may be formed as one continuous web that is folded along the joining fold line. The transverse weld lines may, in one embodiment, seal the adjacent webs along the welded line as well as the inwardly directed bottom fold along the weld line. The triangular base is formed by the inwardly directed gusset fold, which interacts with the bottom fold. Alternatively, a triangular cutout may be removed adjacent the bottom fold, at the position of the transverse weld lines and the inwardly directed bottom fold, separately sealing a portion of the bottom fold to an adjacent web surface and forming triangular base portions.

In forming the bag of the present invention, the web material may be formed as a blown tube, which is flattened and extends forward from the tube-forming machine in a machine direction. The bag is formed transverse to the machine direction, with opposite folded edges of the flattened tube forming the joining fold line. Alternatively, a flattened web may be folded to create a center fold. Other features and advantages of the invention are contemplated and are described in further detail below and incorporated into the associated claims.

BRIEF DESCRIPTION OF DRAWINGS

For the purposes of illustrating the invention, the drawings show various forms of the invention. The invention is not, however, limited to the precise forms shown, unless such limitations are expressly incorporated into the claims.

DETAILED DESCRIPTION

Figure 1:
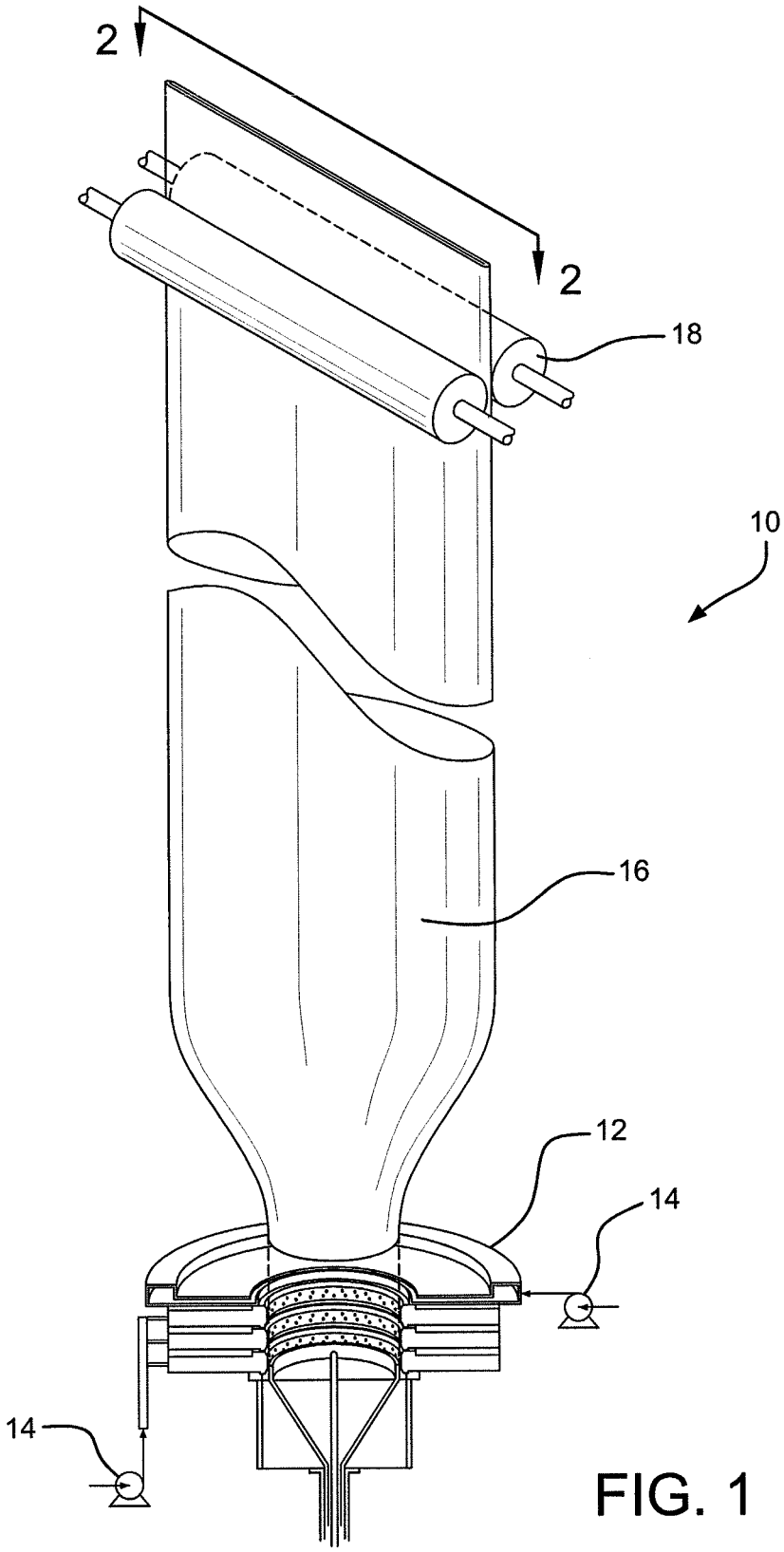
FIG. 1 is a perspective view of the general elements of a polymer tube-forming process.

In the drawings, where like elements identify like numerals, there is shown a number of embodiments of a flat bottom, stand-up bag and a method of manufacturing the bag. In FIG. 1, there is shown a schematic diagram of the formation of a plastic film tube by a blown film process. The process is generally designated by the numeral 10 and includes a die 12, which is contemplated to be of any type commonly available. An extruder 14 supplies plastic material to the die 12. A source of pressurized air is provided to the die opening. The extruded plastic material passing through the die 12 in conjunction with the pressurized air generally forms a continuous, seamless plastic film tube 16. The tube 16 extends upwardly from the die 12 and is collapsed by a pair of opposing pinch rollers 18. The position of the pinch rollers may vary and will typically be provided after the plastic tube has cooled and solidified. After passing through the pinch rollers 18, the tube 16 assumes a flattened or collapsed configuration, as shown in the cross section of FIG. 2.

Upon being collapsed, the tube 16 may move to further stations for additional processing. For example, the collapsed tube 16 may be wound onto a core and retained for further processing at a later time. Treatment of the web material may be incorporated into the process, such as corona treatment of the outside surface of the web (not shown).

Figure 2:
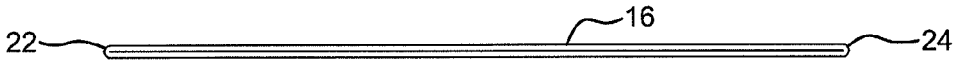
FIG. 2 is a cross-sectional view of a flattened tube as taken along line 2-2 in FIG. 1.
Figure 3:
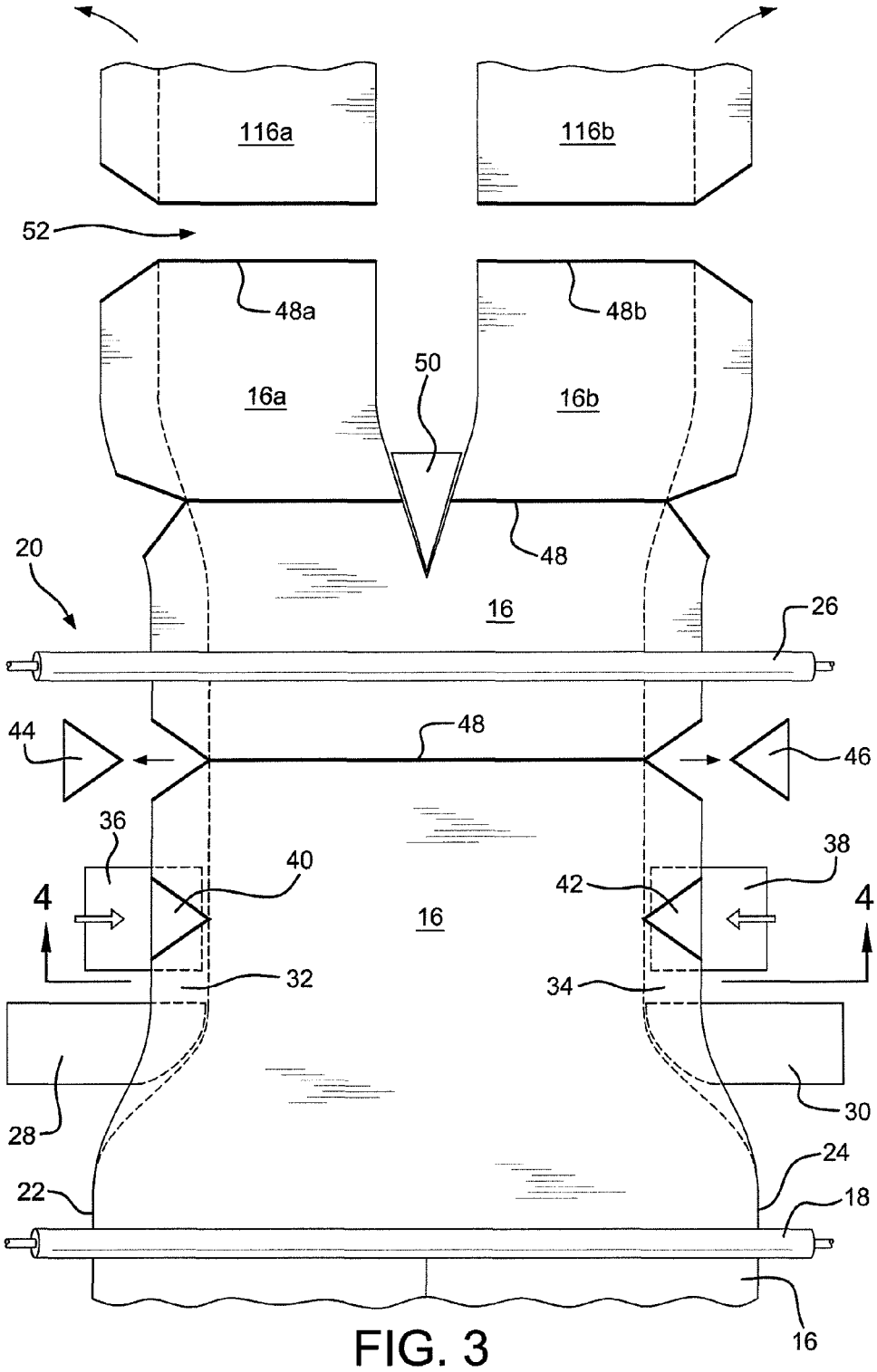
FIG. 3 generally shows a process for forming a flat bottom bag in accordance with one embodiment of the present invention.

In FIG. 3, there is shown a process for forming flat bottom bags on a continuous basis. The formation apparatus is generally designated by the numeral 20 and may be positioned immediately after the pinch rollers 18 of the forming apparatus 10 of FIG. 1. As discussed above, the tube 16 moves through pinch rollers 18 to form a collapsed tube (FIG. 2). The collapsed tube 16, including folded ends 22, 24 positioned on opposite sides of the flattened structure. The two parallel web layers extend between the ends 22, 24, which for fold line with the web layers extending inwardly to a center position.

Figure 4:
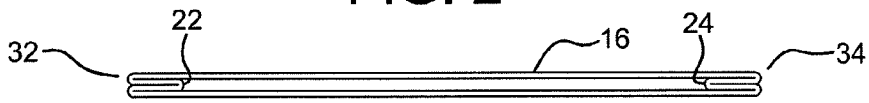
FIG. 4 is a cross-sectional view of a folded tubular member as taken along line 4-4 in FIG. 3.

As illustrated in FIG. 3, pinch rollers 18 serve as nip rollers at the bottom end of the formation process 20. A separate set of rollers 26 serve as draw rollers for the web. The flattened tube material 16 between the nip rollers 18 and the draw rollers 26 is tensioned, maintaining the web material smooth, flat and in a fixed position during processing. As the flattened tube 16 moves past the nip rollers 18, it encounters pleat forming guides 28, 30 positioned on opposite sides of the tube 16. The pleat forming guides 28, 30, as graphically illustrated, create an inwardly directed folded edge about the position of the end lines 22, 24. As shown in FIG. 4, the folded edges 22, 24 are directed inwardly between the adjacent webs. Thus, the pleat guides 28, 30 create inwardly directed bottom folds 32, 34 on opposite sides of the collapsed tube 16.

The tube 16 with the inwardly directed bottom folds 32, 34 continues forward from the pleat guides towards the draw rollers 26 (upwardly in FIG. 3). Blade anvils 36, 38 are inserted into the bottom folds 32, 34, respectively. In addition, triangular heating elements 40, 42 are moved into contact with the web surfaces along the bottom folds 32, 34 on opposite sides of the tube 16. The triangular heating elements 40, 42 are graphically illustrated in FIG. 3 and are positioned in line with the respective blade anvils 36, 38. The heating elements serve to fuse the folded web layers at the position of the blade anvils 36, 38. The anvils 36, 38 serve to maintain the upper and lower portions of the bottom folds 32, 34 separate and therefore these portions do not fuse together during the heating process.

As the flattened tube continues to move toward the draw rollers 26, triangular portions of material 44, 46 are removed from the folded web 16. The triangular web portions 44, 46 correspond to the opposing sides of the bottom folds 32, 34. In addition, a top and bottom triangular portion is removed from each side edge. These top and bottom portions correspond to upper and lower portions of the bottom folds that are positioned on opposite sides of the anvils 36, 38. It should be noted that a number of finals of heating elements may be utilized in order to create the triangular web portions 44, 46 and to remove the material from the tubular web. Preferably, the heating elements or dies 40, 42 are configured to intermittently contact the web material and may be in the form of reciprocating members, which move towards the web material (on opposite sides of the anvils 36, 38) in a timed relationship with the movement of the web between the nip rollers 18 and draw rollers 26. The timing relationship defines the separation between adjacent bags. FIG. 3 illustrates sequential fusing of the web by heating elements 40, 42 followed by the removal of the triangular web portions 44, 46. The triangular web portions 44, 46 may be removed simultaneously with the fusing of the web material at the position of the anvils 36, 38.

At the position of the removal of the triangular web portions 44, 46, there is shown a separate heating operation that forms a side seal 48. The side seal 48 extends from the apexes of the opposing triangular notches, formed by removal of the web portions 44, 46. It is contemplated that the tubular web 16 is fused along the angled surfaces of the triangular notches 44, 46 and that the sealing line continues along the side seal 48.

After the sealed web 16 moves through the draw rollers 26, a knife blade 50 separates the web 16 into separate web halves 16*a* and 16*b*. The knife blade 50 is generally shown and may be of any known structure, including a sharp knife edge, a heated wire, or the like. The web portions 16*a*, 16*b* continue to move away from the knife blade 50 by means of rollers or the like (not shown). In a timed relationship, the web portions 16*a*, 16*b* are separated from the continuous tube 16 at the position of the side seal 48 to form separate bag forms 116*a*, 116*b*. The separation of the bag forms 116*a*, 116*b* are generally designated at position 52. A reciprocating knife blade or scoring roller may be utilized to perform the separation operation. After separation, the bag forms 116*a* and 116*a* as shown have a similar construction and size. It is contemplated that the bag fauns may vary in transverse length (i.e., laterally across the page as shown in FIG. 3). In the process shown in FIG. 3, the bag forms 116*a*, 116*b*, once formed and separated, will be moved transverse to the direction of the forming machine 20 for further processing, such that as illustrated in FIG. 5.

Figure 5:
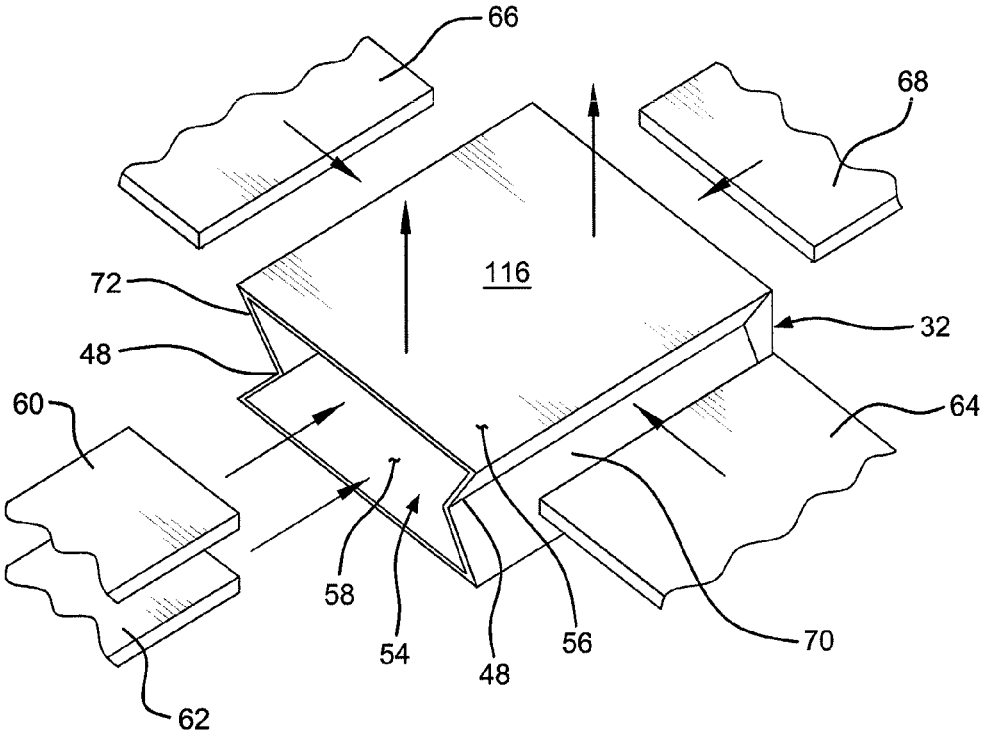
FIG. 5 shows the formation of side gussets within a bag formed in accordance with the present invention.

In FIG. 5, a single bag form 116 is shown. The inwardly directed bottom fold 32 is positioned opposite of an open end 54. Open end 54 is formed by the separation of the two bag forms 116*a*, 116*b* by the knife blade 50 (FIG. 3). The adjacent web surfaces of the bag form 116 serve as the front wall 56 and rear wall 58 of the resulting bag. During processing, the front and rear walls 56, 58 are separated, such as by an externally applied suction or an internally directed puff of air, to open the end of the bag 54. Once opened, formation paddles 60 and 62 are inserted inside the bag form 116, between the front and rear walls 56, 58. Gusset paddles 64, 66 are directed towards the side edges of the bag form 116, at the position of the opposing side seals 48 and between the spaced formation paddles 60, 62. In a timed relationship with the gusset paddles 64, 68, a bottom fold paddle 68 is directed into the bottom fold 32. The timed relationship between the paddles is such that gussets 70, 72 are formed on both sides of the bag faun 116.

The side gussets 70, 72 are defined at their center by the side seal 48. At the bottom edge of the bag form 116, the side gussets 70, 72 interact with the bottom fold line 22 (or 24), which is maintained in the bag form 116 by the timed insertion of the bottom fold paddle 68. As such, a flat bottom gusset is formed, with a central fold, along with inwardly folded side gussets 70, 72. A triangular support element is formed at the base of the side gussets 70, 72, adjacent their intersection with the bottom fold line 22.

Figure 6:
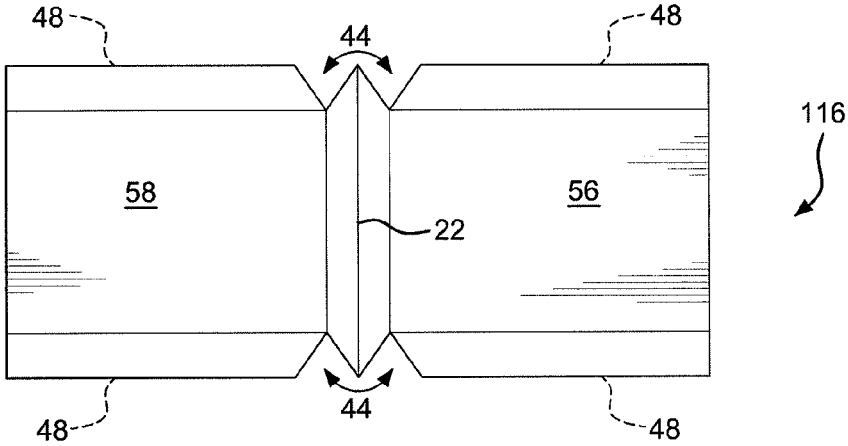
FIG. 6 is a view of the disassembled blank for a formed bag in accordance with the embodiment of FIGS. 3-5.

In FIG. 6, the separated blank of the bag form 116 is shown, with the sealed seams, such as side seams 48, being separated for illustration of the final bag construction. The front and rear walls 56, 58 of the bag are positioned on opposite sides of the fold line 22, with the side seals 48 separated and defining the lateral edges of the blank. The removed triangular portions (44) define two notches on opposite sides of the fold line 22.

Figure 7:
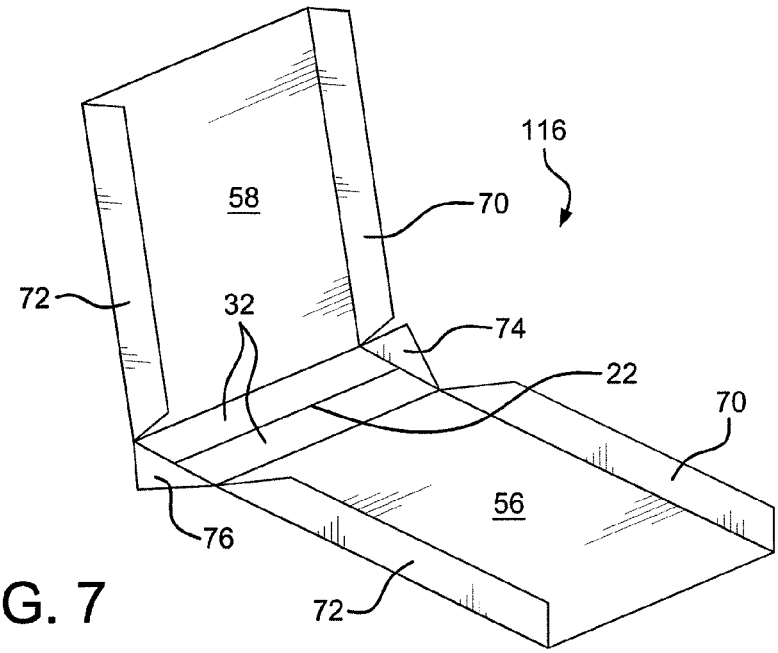
FIG. 7 is a further view of the disassembled blank of the formed bag contemplated by FIGS. 3-6.

The folding of the bag form 116 to create a completed bag is more particularly illustrated in FIG. 7. The front and rear walls 56, 58 are shown with the side gussets 70, 72 and the bottom wall 78 positioned there between. When the gussets 70, 72 are formed in conjunction with the maintenance of the inwardly directed bottom fold 32, the triangular portions 74, 76 are defined along the sealed edges of the bag. Thus, the side seals (48) extend downwardly and join the triangular portions 74, 76 at their apex. The triangular portions 74, 76 form a base for the bag at the intersection of the inwardly directed bottom fold and the inwardly directed gusset folds.

Figure 8:
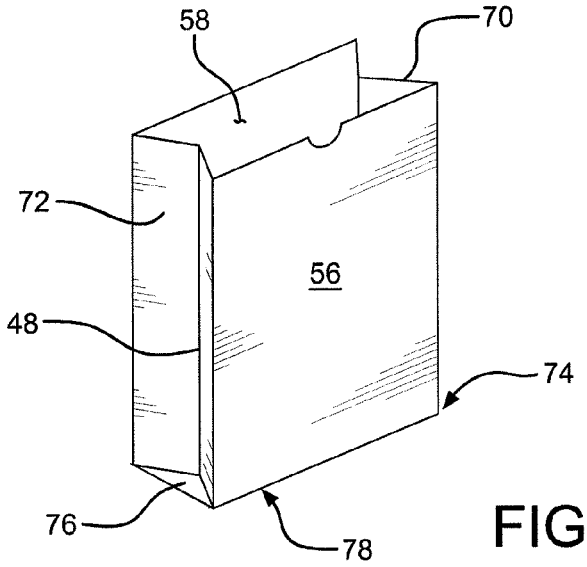
FIG. 8 shows a perspective view of a formed and assembled bag in accordance with the embodiment contemplated by FIGS. 3-7.

A formed bag is shown in FIG. 8. Side gussets 70, 72 are positioned between the front and rear walls 56, 58 and generally serve as the side walls for the bag. Triangular base portions 74, 76 are positioned at the bottom of the gussets 70, 72. The formed side seams 48 are positioned centrally within the side gussets 70, 72 and terminate at the triangular base portions 74, 76. The front and rear walls 56, 58 are continuously formed with the bottom wall (generally designated as 78). The continuous nature of the front wall 56, bottom wall 78, and rear wall 58 serve to strengthen the bag during use. A stable platform for supporting the bag erect is created by the combination of the bottom wall and the triangular base portions 74, 76.

As an alternative to the flattened tube having tube layers, the manufacturing process may start with a continuous flat web. Such a flat web material may be created, for example, by removing the folded ends 22, 24 from the tube, creating two separate flat web portions. The two web portions my each then be separately wound onto a core or otherwise directed for processing. Another potential alternative is the use of a cast film. In using a flat web material, the formation of the bottom fold line at the side edge of folded web portions may be created in a number of ways. For example, the web material may be provided with a V-fold, such that two adjacent surfaces of the web are brought together and extend from a (preferably) central fold line. The open end of the bag form is then opposite of the fold line. The web material may then be moved in a continuous manner between parallel rollers, with essentially half of the process machine of FIG. 3 being utilized. Further, adjacent web layers may be sealed along a side edge to create the bottom fold line. This construction would result in the front and rear walls not being continuously formed along with the bottom wall. Although this bottom seal line constructions is not preferred, the remaining steps of the defined process of the present invention could then be utilized to construct the bag.

Generally, the bag is formed in a transverse direction to the machine direction in the formation or movement of the web material. Thus, as the web moves between the parallel rollers (upwardly in FIG. 3), the side edges of the bag (formed by side seals 48) are positioned transverse to the machine direction. Ultimately, after separation of a bag from the web (52), the gusset is formed separate from the formation of the bag blank (such as in FIG. 5).

Figure 9:
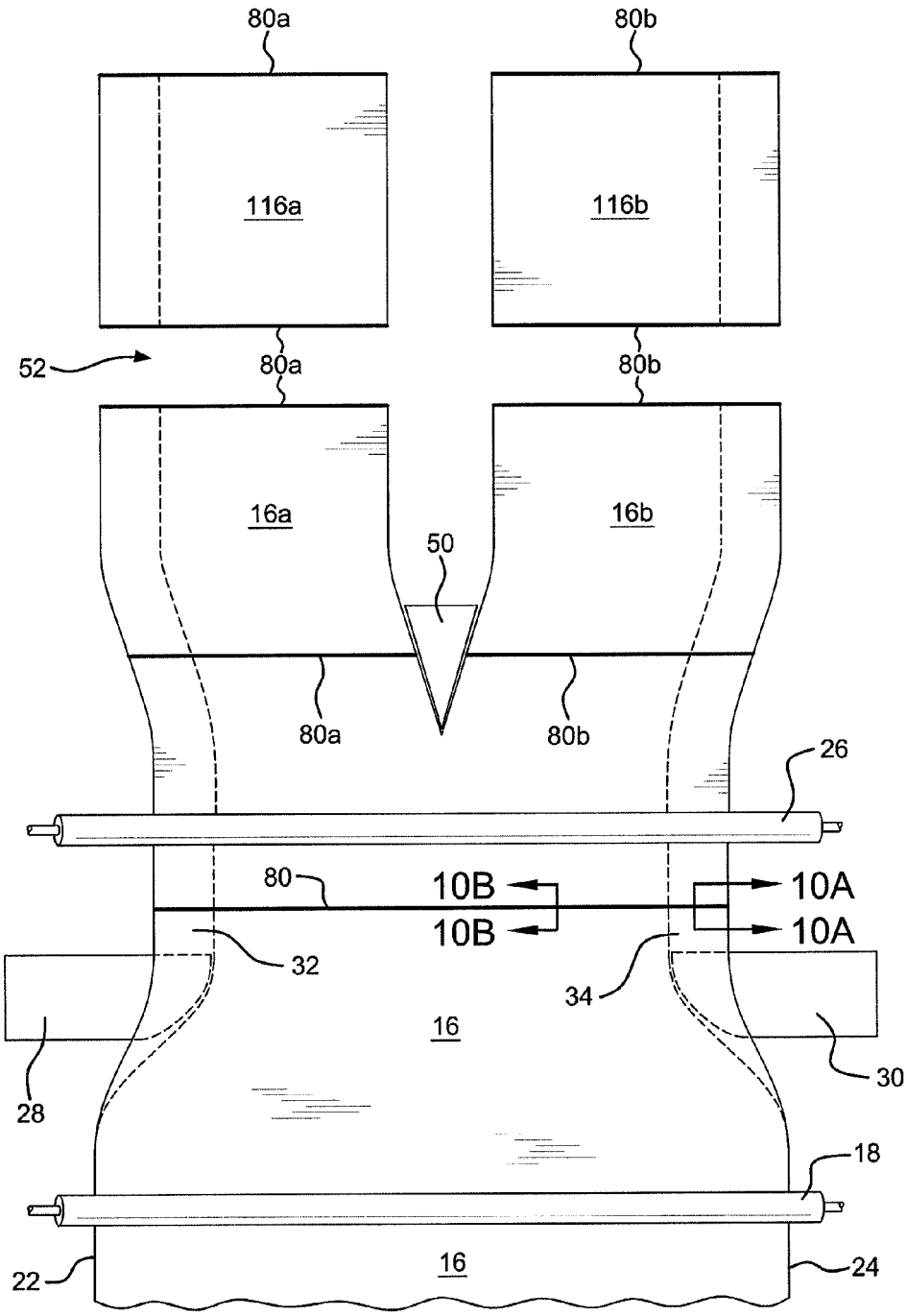
FIG. 9 generally shows a process for forming an alternate construction of a flat bottom bag in accordance with the present invention.
Figure 10A:
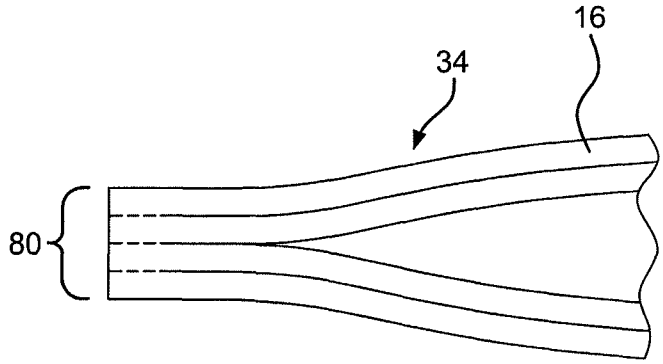
FIGS. 10A and 10B are partial cross-sectional views taken along the correspondingly designated lines in FIG. 9.
Figure 10B:
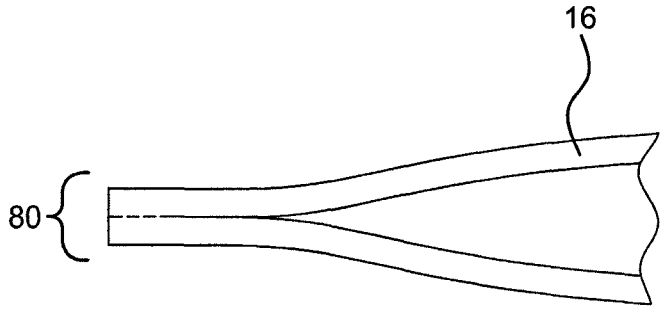

In FIG. 9, there is provided an alternate embodiment of a bag as contemplated by the present invention. In FIG. 9, the web material 16 in the folded condition (FIG. 2) is directed by nip rollers 18 and draw rollers 26 toward pleat forming guides 28, 30. The guides 28, 30 form an inwardly directed bottom fold on opposite sides of the web. In FIG. 9, the bottom folds are again designated as 32 and 34, with the initial process being the same as that contemplated by FIG. 3. After leaving the forming guides 28, 30, a side seal 80 is formed transverse to the movement of the web 16. The side seal 80 extends across the width of the web 16 and includes the bottom folds 32, 34. As shown in FIG. 10A, the side seal 80 fuses four layers of web material together, within the area of the inwardly directed bottom fold 32. Further inwardly on the web, as shown by FIG. 10B, the side seal is formed by fusing only two layers.

Returning again to FIG. 9, after formation of the side seal 80, the web 16 moves through the draw rollers 26. The web 16 is then brought into contact with the knife blade 50 to form two web portions 16*a*, 16*b*. The web portions 16*a*, 16*b* are then separated, by cutting or the like, at position 52, forming two bag forms 116*a* and 116*b*. The bag forms 116*a*, 116*b* in FIG. 9 differ from the bag forms of FIG. 3 in that no triangular portions have been removed from the web and angled seals have not been created.

Figure 11:
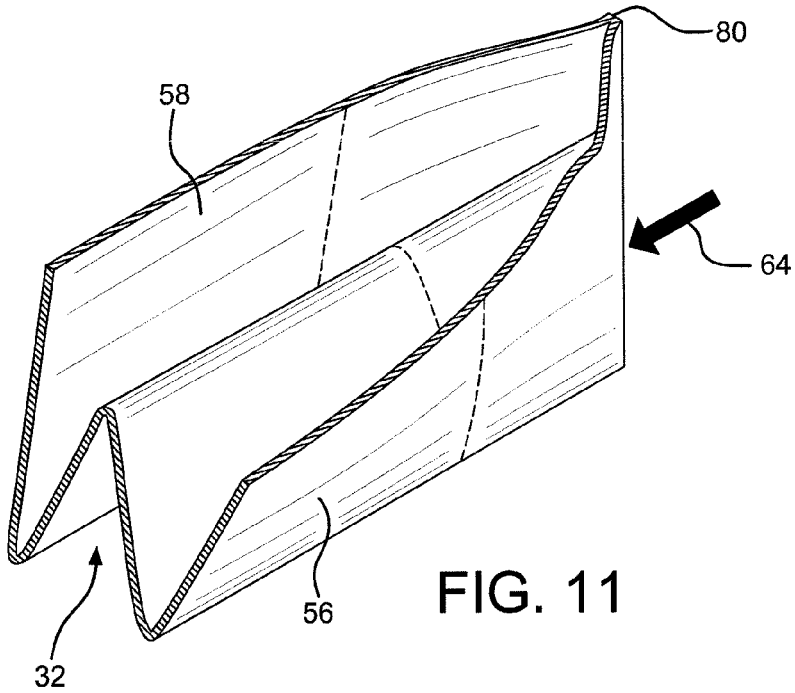
FIG. 11 is a partial perspective view of a bag being formed in accordance with the embodiment of FIGS. 9 and 10.
Figure 13:
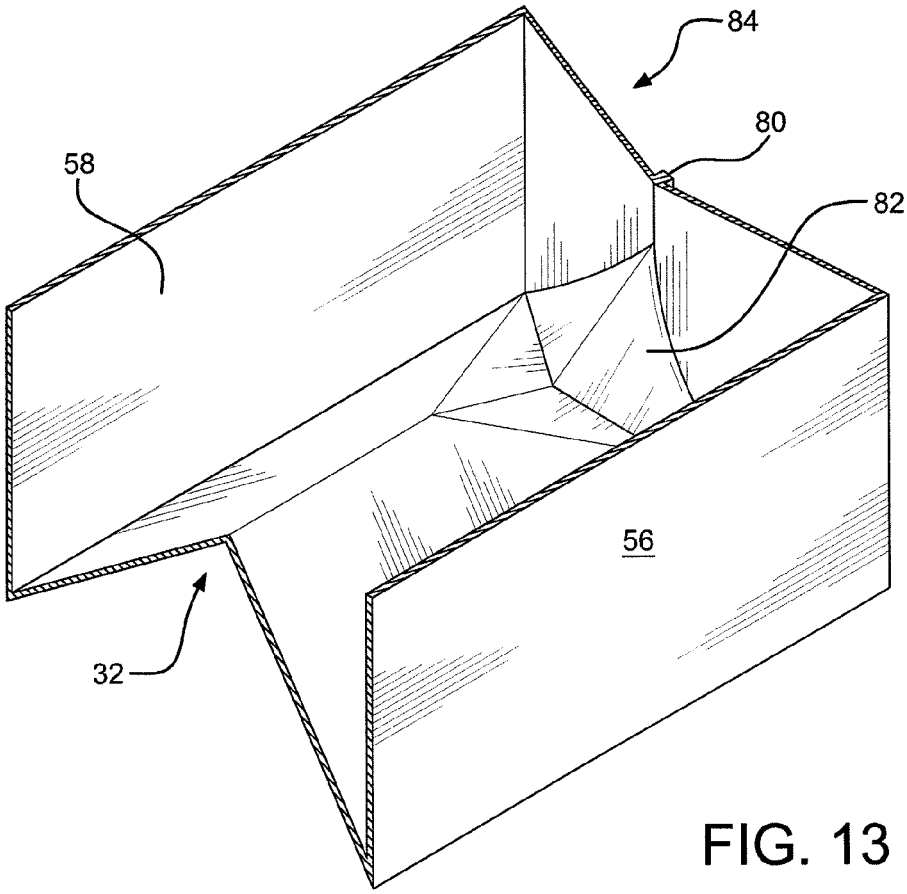
FIG. 13 is a partial perspective view taken along line 13-13 in FIG. 12.
Figure 12:
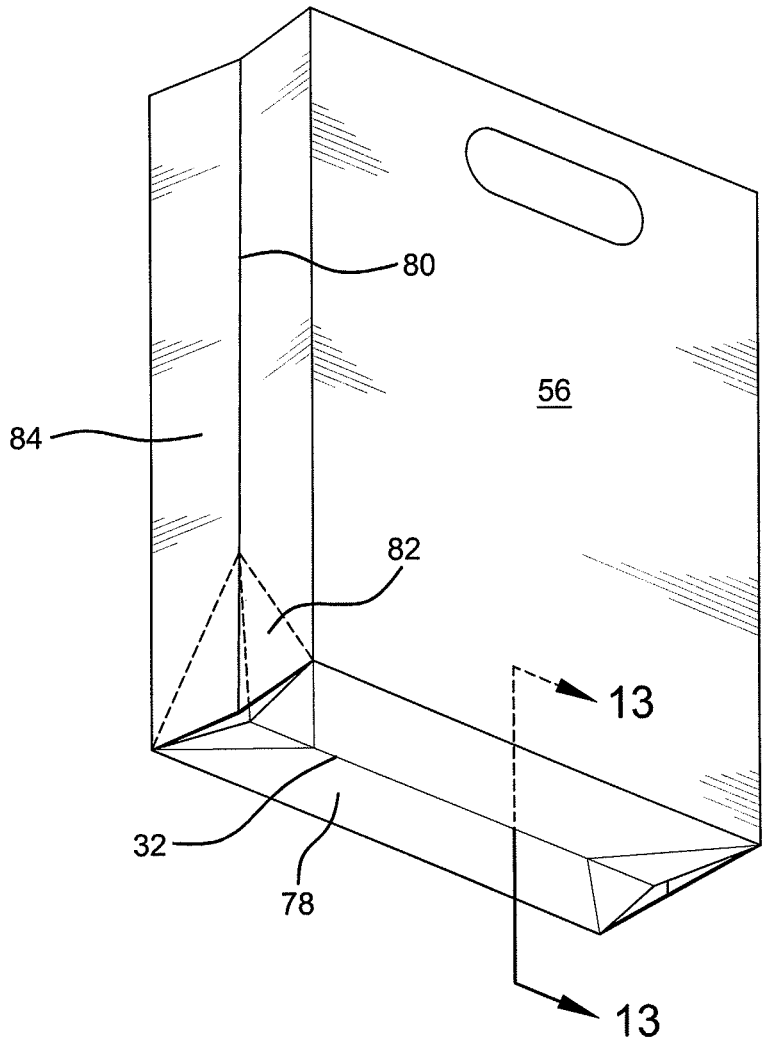
FIG. 12 is a partial perspective view of a formed bag of the embodiment of FIGS. 9-11.
Figure 14:
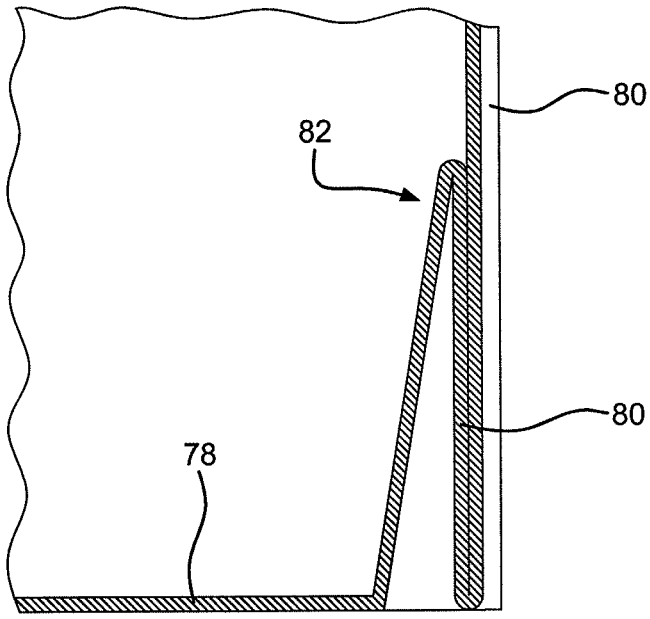
FIG. 14 is a partial cross-sectional view of the bottom and side portions of the embodiment of FIGS. 9-13.

In FIG. 11, the side seal 80 within one corner of the bag forms 116*a*, 116*b* is shown prior to the creation of the side gussets. The inwardly directed bottom fold 32 is positioned between the front wall 56 and rear wall 58. The side gussets are contemplated to be formed in the manner shown by FIG. 5, with the motion of the gusset paddle 64 (or 66) of FIG. 5 being represented by the arrow in FIG. 11. The paddle operation maintains the bottom fold 32 while creating the side gussets (labeled as 84 in FIG. 12). FIG. 13 shows the formed side gusset. A triangular fold 82 is formed along the side gusset. This triangular fold 82 is also shown in phantom in FIG. 12. The fold results from the maintenance of the bottom gusset 32 (by paddle 68 in FIG. 5) and movement of the gusset paddle (64, 66 in FIG. 5) during the creation of the side gussets 84. The side seal 80 extends to the bottom edge of the bag, with the triangular fold 82 being positioned inwardly at the base. As shown in the cross section of FIG. 14, triangular member 82 extends upwardly from the bottom wall 78 and forms an apex along the side seal 80. The triangular base member 82 is an extension of the web material that forms the bottom wall 78.

As indicated above, the formation of the bag by the present method results in a bag having a front and rear walls formed from web material that continues along the bottom wall of the bag, without overlapping folds and preferably without seams. Side seals are formed within the side wall portions that include gussets and triangular supports at the base of the bag, at the intersection between the side gussets and the bottom wall.

Figure 15:
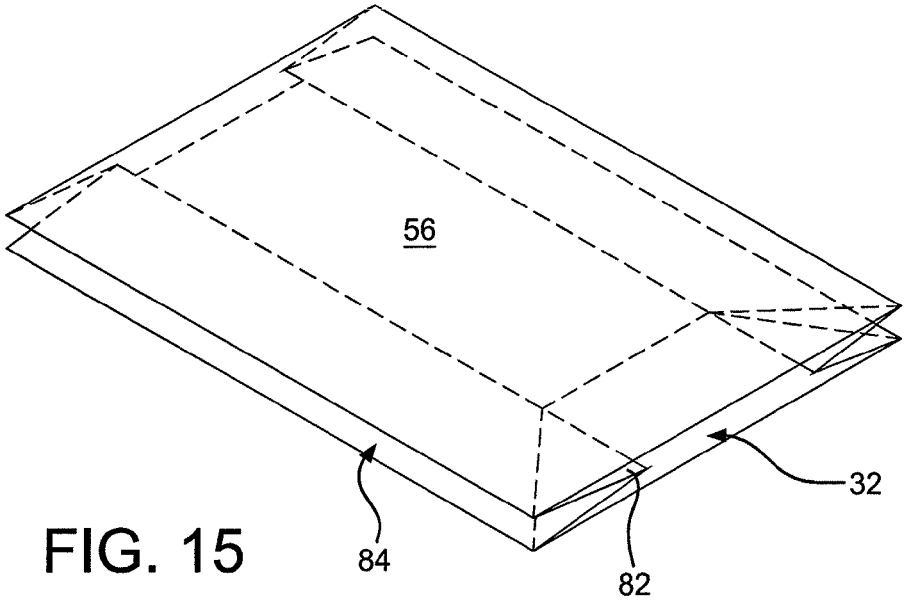
FIG. 15 a perspective view of the bag embodiment of FIGS. 9-14 as formed and folded flat for storage.
Figure 16:
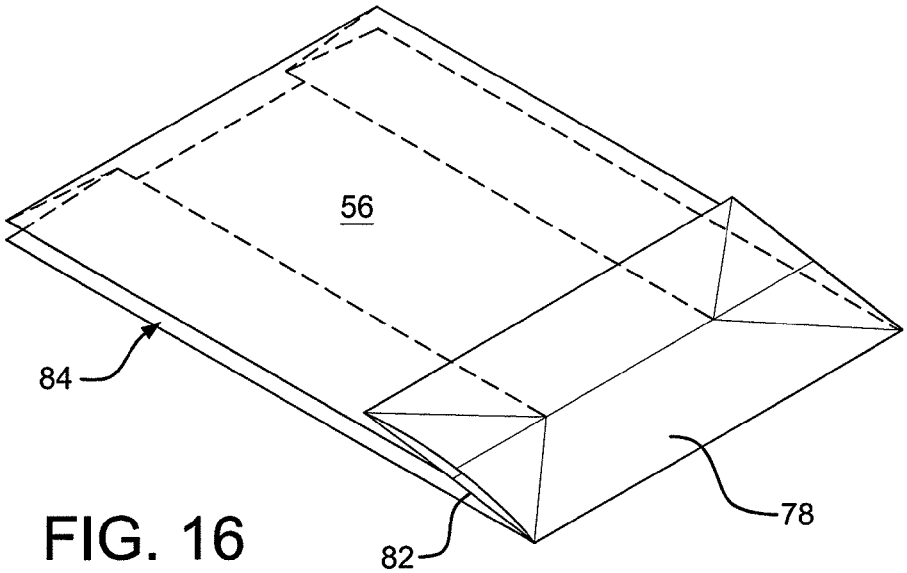
FIG. 16 is a perspective view of the bag embodiment of FIGS. 9-14 as formed and folded flat in an alternate manner from that shown in FIG. 15.

In FIGS. 15 and 16 there is shown formed bags which are folded into a flattened condition. In FIG. 15 the bottom gusset 32 is retained at the bottom of the bag, with the side gussets 84 directed inwardly. This flattened bag is acceptable for storage and shipment. In addition, the bag may be easily opened from the top to create a relatively flat bottom platform, in the manner shown in FIGS. 8 and 12. In FIG. 16, the bag is folded in a manner typical for shopping bags and paper grocery bags. The bottom gusset is flattened to create a flat bottom surface 78. The folded bottom is then turned upwardly against the front wall 56. The side gussets 84 remain, while the triangular folds 82 (or triangular base members 76) are turned and lays adjacent the bottom wall portion 78. Either folding form is acceptable, although the customer may prefer on over the other.

A number of materials may be utilized to create the bag embodiments described above, including co-extruded blown polymer films, such as high-density polyethylene, medium-density polyethylene and low-density polyethylene. Preferably, a medium molecular weight, high-density polyethylene film will provide the desirable attributes for stiffness, wall thickness and strength. However, the contemplated invention is not limited to this specific material. Additional elements may be included within the finished bags, such as handles, clasps, windows, etc. The handle elements may be separately attached to the surfaces of the bag, by heat bonding, adhesives, mechanical attachment, etc. Openings may also be provided in the bag walls to form handles. For example, an oval opening may be provided through the front wall 56 and rear wall 58 at a position inwardly of the top edge. In addition, a hem may be provided at the tope edge to create a more finished appearance. The bag materials may be printed as desired or a colorant may be added during the extrusion of the raw materials.

The present invention may be embodied in other specific forms without departing from the spirit and central attributes thereof. Accordingly, reference should be made to the appended claims, rather than the foregoing specification as indicating the scope of the invention.

I claim:

1. A method of forming a bag having a bottom wall, opposing front and rear walls and two sidewalls, the method comprising the steps of:

a) providing two adjacent webs of material, the adjacent webs continuously formed with one another and folded along one edge, defining a fold line, two parallel web extending from the fold line with two projected ends positioned opposite the fold line;

b) moving the webs in a forming direction that is transverse to their direction of extension from the fold line;

c) providing an inwardly directed bottom gusset fold along the fold line, such that the fold line is positioned between the web layers, wherein the bottom gusset fold defines a bottom edge of the bag;

d) joining the web layers along a first seal line transverse to the inwardly directed bottom gusset fold and transverse to the forming direction, the first seal line extending inwardly from the bottom edge;

e) joining the web layers along a second seal line transverse to the inwardly directed bottom gusset fold, the second seal line extending inwardly from the bottom edge, and the second seal line spaced from and parallel to the first seal line;

f) separating a portion of the web material defined between the first seal line and the second seal line;

g) forming an inwardly directed side gusset fold along both the first and second seal lines, such that the inwardly directed side gusset folds are positioned between the web layers and transverse to the bottom gusset fold, the side gusset folds defining sidewalls for and extending from the bottom edge of the bag; and h) the forming of the side gusset folds and the inwardly directed bottom gusset fold combining to form a pair of folded triangular base portions, the folded triangular base portions continuously formed with and connected to the inwardly directed bottom gusset fold, each folded triangular base portion extending upwardly from the bottom gusset fold and one folded triangular base portion positioned adjacent each of the inwardly directed side gusset folds, the folded triangular base portions sealed along their height to the adjacent first and second seal lines and positioned inwardly of the side walls and the seal lines.

2. The method as in claim 1, further comprising the steps of: forming a continuous web, and folding the continuous web along the fold line to form the two adjacent webs.

3. The method as in claim 1, wherein the folded triangular base portions comprise an open folded portion positioned between the bottom gusset fold and the first and second seal lines.

4. The method as in claim 1, wherein the joining steps occur incrementally during movement of the webs in the machine direction.

5. The method as in claim 4, wherein the formation of the folded triangular base portions occurs sequentially after the joining steps for the first and second seal lines.

6. The method as in claim 1, wherein the material webs are formed from a polymer material.

7. The method as in claim 6, wherein the polymer material is heat weldable and the joining steps for the first and second seal lines are conducted by heat sealing the adjacent web layers together.

8. The method as in claim 6, wherein the polymer material comprises high density polyethylene.

9. The method of claim 1, further comprising the step of spacing the web material relative to one another prior to providing the inwardly directed gusset folds.

10. A method of forming a bag having a bottom wall, and a plurality of upstanding walls, including a front wall, a rear wall and a pair of opposing sidewalls, the upstanding walls joined with and extending from the bottom wall, and the walls defining a storage volume there between, the method comprising the steps of:

providing a continuous polymer web;

providing a fold line within the polymer web by positioning two web layers parallel and adjacent one another, the web layers integrally formed with one another, extending from the fold line and defining two projected layer ends opposite the fold line, the parallel web layers forming at least front and rear walls of the bag to be formed;

moving the web in a machine direction parallel to the direction of the fold line and transverse to the projected extension of the web layers;

forming a bottom gusset fold by directing the fold line transverse to the machine direction and between the adjacent web layers, the bottom gusset fold forming a continuous bottom wall, the bottom wall continuously formed with the front and rear walls of the bag to be formed;

sealing the web layers along spaced first and second sealing lines, the sealing lines directed transverse to the machine direction, and the sealing lines each extending across the bottom gusset fold;

separating the portion of the layers between the spaced first and second sealing lines to form a bag blank;

folding the web layers adjacent each of the first and second sealing lines to create inwardly directed side gusset folds within the bag blank, the gusset folds positioned transverse to the bottom gusset fold and the side gusset folds forming the sidewalls for the bag; and forming folded triangular base portions at a base of and inwardly of the sidewalls, the folded triangular base portions continuously formed with the bottom wall, joined to the adjacent sealing lines and positioned along the side gusset folds.

11. The method as in claim 10, wherein the folded triangular base portions comprise an open folded portion, wherein the oven fold is positioned between the bottom fold and the sidewalls of the bag.

12. The method as in claim 11, wherein the formation of the folded triangular base portions occurs simultaneously with the folding of the web layers to form the inwardly directed side gusset folds and sequentially after the sealing and separating steps.

13. The method as in claim 10, wherein the polymer material comprises high density polyethylene.

14. The method as in claim 10, wherein the polymer material is heat weldable and the sealing step for the first and second seal lines are conducted by heat sealing the adjacent web layers together.

15. The method of claim 10, further comprising the step of spacing the web layers relative to one another prior to folding the inwardly directed gusset folds.

16. A method of forming a bag having a bottom wall, opposing front and rear walls extending from the bottom wall, two sidewalls extending from the bottom wall and connecting the front and rear walls, the walls defining a storage volume there between, the method comprising the steps of:

providing a continuous polymer web;

providing a fold line within the polymer web by positioning two web layers parallel and adjacent one another, the web layers integrally formed with one another, extending from the fold line and defining two projected layer ends opposite the fold line, wherein the front and rear walls of the bag are formed from the parallel web layers;

moving the web in a machine direction parallel to the direction of the fold line and transverse to the projected extension of the web layers;

continuously forming a bottom gusset fold by directing the fold line transverse to the machine direction and between the adjacent web layers, the bottom gusset fold defining a bottom edge of the bag and the bottom wall of the bag, the bottom gusset fold integrally formed with the two web layers projecting therefrom in a direction transverse to the machine direction;

sequentially sealing the web layers and the bottom gusset fold at spaced intervals in the machine direction, the sequential sealing steps forming parallel and continuous seal lines extending from the bottom edge of the bag and transverse to the machine direction, the sequential seal lines having a portion of the web layers extending there between;

separating a portion of the web layers adjacent sequential seal lines to define a bag blank, the bag blank having an open end opposite of the bottom gusset fold;

defining the sidewalls of the bag by providing inwardly directed gusset folds along both seal lines within the bag blank, the side gusset folds positioned between the web layers within the bag blank and transverse to the bottom gusset fold, and the side gusset folds forming sidewalls along the seal lines within the bag blank; and forming folded triangular base portions along with the inwardly directed gusset folds, the folded triangular base members sealed at the seal lines adjacent the bottom edge of the bag, projecting inwardly from and extending along the sidewalls, the folded triangular continuously and integrally formed with the bottom wall, the base of the triangular portions serving to space the front and rear walls.

17. The method of claim 16, further comprising the step of spacing the web layers relative to one another adjacent the side seals prior to providing the inwardly directed side gusset folds.

* * * * *